United States Patent [19]

Kawano

[11] 3,970,039

[45] July 20, 1976

[54] HIGH SPEED CARBONIZING MACHINE

[75] Inventor: Mak S. Kawano, Wheaton, Ill.

[73] Assignee: American Tara Corporation, Chicago, Ill.

[22] Filed: Sept. 18, 1975

[21] Appl. No.: 614,553

[52] U.S. Cl. ..... 118/60; 118/103; 118/119; 118/262

[51] Int. Cl.[2] ..... B05C 1/08; B05C 11/04

[58] Field of Search ..... 118/103, 118, 119, 123, 118/126, 202, 60, 262, 69; 427/153

[56] References Cited

UNITED STATES PATENTS

| | | | |
|---|---|---|---|
| 2,163,712 | 6/1939 | Shearer | 118/103 X |
| 2,221,441 | 11/1940 | Charters | 118/104 |
| 2,529,699 | 11/1950 | Lach | 118/123 |
| 3,084,663 | 4/1963 | Warner | 118/104 |

*Primary Examiner*—John P. McIntosh
*Attorney, Agent, or Firm*—Barry L. Clark

[57] ABSTRACT

Apparatus for carbonizing a tissue paper web has an improved inking section which permits tissue to be coated, with or without uncoated striped areas, at speeds up to about 3,000 feet per minute. A first doctor blade positioned upstream of a second doctor blade and an equalizer rod contacts the paper very lightly so as to remove some of the excess thickness of ink on the paper, thus reducing the amount of ink to be removed by the second doctor blade and the equalizer rod. The equalizer rod is made of hardened wire of a very small diameter, preferably about 0.047 inches, and is supported under tension in a shallow v-groove by a pair of chucks which are rotated together.

13 Claims, 5 Drawing Figures

HIGH SPEED CARBONIZING MACHINE

BACKGROUND OF THE INVENTION

This invention relates to the field of coating of webs and particularly to the application of a very thin carbon ink coating to a tissue paper web used in the manufacture of one time carbon paper for business forms. Typically, prior art devices for coating carbon paper include a heated coating roller which picks up ink on its surface from a pan of hot ink in which it rotates in a direction opposite to the feed direction of the web. The ink is transferred in a relatively thick layer to the tissue paper web which is guided, while under tension, into contact with the roller. The thick layer is then reduced to a desired thickness by doctor means positioned between the coating roller and a plurality of chill rolls which cause the coating to solidify before it is wound up on a core. Many improvements in doctor devices have been made over the years and such devices are now commonly in the form of a rod, which is usually rotated to distribute wear and is often termed an equalizer rod. Equalizer rods are usually mounted in a groove in a fixed member. Patents which show such devices include U.S. Pat. Nos. 2,001,339, 2,136,739, 2,672,119, 2,695,004, 2,774,329, 3,029,779, 3,063,407, 3,084,663 and 3,304,910. .

Although prior art carbon paper coating machines have been able to produce carbon paper at speeds of as high as about 1,500–1,900 feet per minute, attempts to run significantly faster have been unsuccessful for a number of reasons. One reason for failure has been that high speeds cause flooding and a build up of hydraulic pressure at the equalizer rod which tends to lift the paper and cause too much ink to be left on the paper. The excess ink not only increases cost but is a cause for rejection by the customer since the ink can flake off or smudge or produce fewer legible copies in a typewriter. Smaller diameter rods can produce thinner coatings but are even more prone to flooding. Applying a thinner coating to the paper is not satisfactory since the liquid ink can rip and cause blank areas on the paper.

Another problem has arisen where the carbon paper must be selectively coated to produce uncoated stripes. The uncoated stripes are often required as a surface to which glue may be applied after the paper is slit and is being assembled into business forms. They are also used to provide clean areas for finger gripping or to block out certain information from being reproduced. The stripping is accomplished by thin metal masking strips, preferably brass, which are held at one end so as to lay on top of the rotating coating roller. Small weights mounted above the paper force the paper against the strips and prevent the ink from contacting the paper in the area above the strips. Examples of such strips can be found in U.S. Pat. Nos. 1,476,988, 2,322,533, and 2,330,530. The strips tend to push the ink on the coating roller which is under them to the side so that ink ridges are produced on either side of the uncoated stripes. When the paper is produced in an apparatus where it passes directly from the coating roller to the equalizing rod, ever increasing hydraulic pressures will be produced on the ink coating by the equalizing rod with increases in coating speed. These pressures will force the excess ink in the ridges adjacent the uncoated stripes to move sideways, thus narrowing the stripes and causing the stripe margins to be jagged and irregular.

A third problem caused by the increased hydraulic pressure of high speed contact between the equalizer roll and the ink is that significant quantities of ink particles are propelled upwardly through the pin holes that are usually present in carbonizing tissue. This ink naturally tends to fall back down on the uncoated top side of the carbonized web and results in a dirty product which can transfer ink to the back side of the business forms to which it is assembled and soil the hands of those handling and filing away the forms.

SUMMARY

It is among the objects of this invention to provide a machine for carbonizing paper which overcomes the deficiencies of the prior art machines and produces a good, uniformly coated web of either striped or unstriped carbon paper at speeds substantially greater than ever before possible and as high as about 3,000 feet per minute under suitable operating conditions of temperature and humidity.

The increased speed and uniform coating capability of my machine results from an improved inking section comprising a heated dope or coating roll, a metering rod, two doctor blades and a very small diameter, rotating equalizer roll. The dope roll rotates at about the same surface speed as the web in an ink pan in a direction opposite to the direction of web feed to pick up ink and apply it to the web which contacts it. The metering rod is positioned downstream and very close (about 0.010–0.015 inches) to the dope roll and is preferably rotated in the opposite direction. The spacing of the metering rod controls the amount of ink carried to the paper web and the direction of rotation insures that, in the event of a web break, the paper will not enter the ink pan. The rotating metering rod also allows any foreign particles in the ink to pass onto the paper rather than jamming against the dope roll and causing an uneven ink pattern as can happen with a fixed metering bar. The rotating metering rod also produces a more even coating than is possible when a non-rotating metering rod is used. The first doctor blade is arranged at an angle of about 60° to the vertical so that it lightly touches the paper and shears off some excess ink from the paper. The second doctor blade is at about a 10° angle to the vertical and also lightly contacts the paper and shears off additional ink. The equalizer rod is made of drill rod stock or music wire of a diameter of less than 0.100 inches and preferably about 0.047 inch and is supported in a very shallow v-groove under great tension. The equalizer rod reduces the coating thickness to the desired value which is generally about 1.9 pounds of ink per ream of paper. Although the inking section is the principal contributing factor to increasing coating speed, the machine must also provide sufficient tension (about 1.7–2.0 pounds per inch of width) on the paper web to cause it to properly contact the inking members, sufficient heating capacity for the coating roll and for the ink in the ink pan to keep the ink liquid and workable (about 200°F) and sufficient cooling capacity to chill the ink after coating.

BRIEF DESCRIPTION OF THE DRAWINGS

Figure 1:
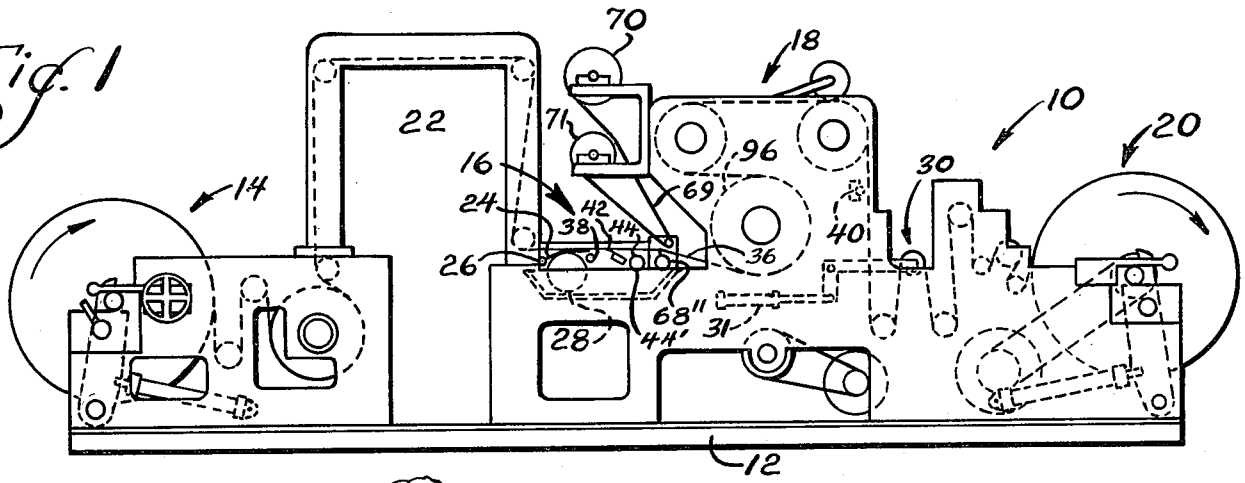
FIG. 1 is a side elevation of a coating machine incorporating my invention.

Referring to FIG. 1, my improved coater 10 includes a base or frame 12 which supports an unwinding section 14, a coating section 16, a chilling section 18 and a rewinding section 20. Since the coated web can be five feet wide, an open walk through area 22 is provided adjacent the coating section 16 to permit an operator to have access to the coating section for cleaning it or to adjust the flat strips 24 which may be mounted on stripe holder 26. The strips 24 overlie or mask those portions of dope or coating roller 28 where it is desired that no coating be applied to the web. Although the coater 10 includes rewind tension control means including an air dancer 30 which is moved up and down by air cylinder 31 for maintaining proper tension on the web 36 as it is being rewound after coating, the control forms no part of the present invention and will not be described in detail.

The coating section 16 includes an ink pan 32 which is preferably constructed to keep the ink 34 at a temperature of about 200°F. The dope roll 28 is also heated since it is important that the ink remain in a liquid state when it contacts the web 36. The dope roll 28 picks up an ink coating as it rotates in pan 32 in a direction opposite to the direction of feed of web 36 but is wiped clean by the web 36 passing over its top. By varying the speed of dope roll 28, the thickness of the initial coating applied to web 36 can be varied slightly. A metering rod or roll 38 is mounted closely adjacent (about 0.010–0.015 inches) to dope roll 28 and is powered for rotation in the opposite direction from the dope roll. The metering rod has several important functions. The main function is to limit the maximum thickness of ink that can reach the web 36 by controlling the distance between the surfaces of the dope roll 28 and the metering rod 38. This function can be generally performed by a non-rotating metering rod. However, by rotating the metering roll 38 and having the rolls 28,38 rotate in opposite directions relative to each other, any particle of paper or other foreign matter which is in the ink 34 that attaches itself to the dope roll 28 will tend to be positively carried through the nip between the rolls and be deposited on the web 36. I have found that when a fixed metering rod is used, foreign matter particles, such as particles of paper, can tend to build up and form a solid mass which projects into the nip between the rod and the rotating dope roll and decreases the ink coating thickness on the dope roll in the region of the build up. Obviously, the reduced thickness can result in a non-uniform final coating on the web which could result in the entire roll being scrapped if not detected. Although it is possible that screening and/or filtering could reduce or eliminate foreign matter particles, I have also found that a rotating metering rod causes the dope roll to pick up a much more uniform coating than it does when a non-rotating metering rod is used.

A wide inspection light 40 is provided behind the web 36 for facilitating the visual detection of coatings which are too thick, too thin, or uneven. Since the web 36 is tissue thin, and somewhat translucent, variations are easy to detect.

Downstream of the metering roll 38 is a first doctor blade 42 which is mounted so as to be able to scrape off excess ink from the web 36 while only lightly contacting the web. The second doctor blade 44 also lightly contacts the web 36 and removes an additional portion of the remaining coating. The first doctor blade 42 is at an angle of about 60° to the vertical to facilitate the flow of the removed ink down into the ink pan 32. The second doctor blade 44 is preferably at an angle of about 10° to the vertical. The equalizer rod 46 contacts the web 36 after it leaves doctor blade 44 and shears off the remaining excess coating. In order to achieve the desired final coating thickness of about 1.9 pounds of ink per ream of paper, at speeds of up to about 3,000 feet per minute, the rod 46 must be of very fine diameter, less than 0.100 inches and preferably less than about 0.078 inches. I have achieved especially good results where the rod 46 is about 0.047 inches. Although I use hardened music wire or drill rod stock for rod 46 I have found that the wire will wear flat quickly if it is not rotated during use. A rotation speed of about 5 rpm is satisfactory.

Figures 3, 4, 5:
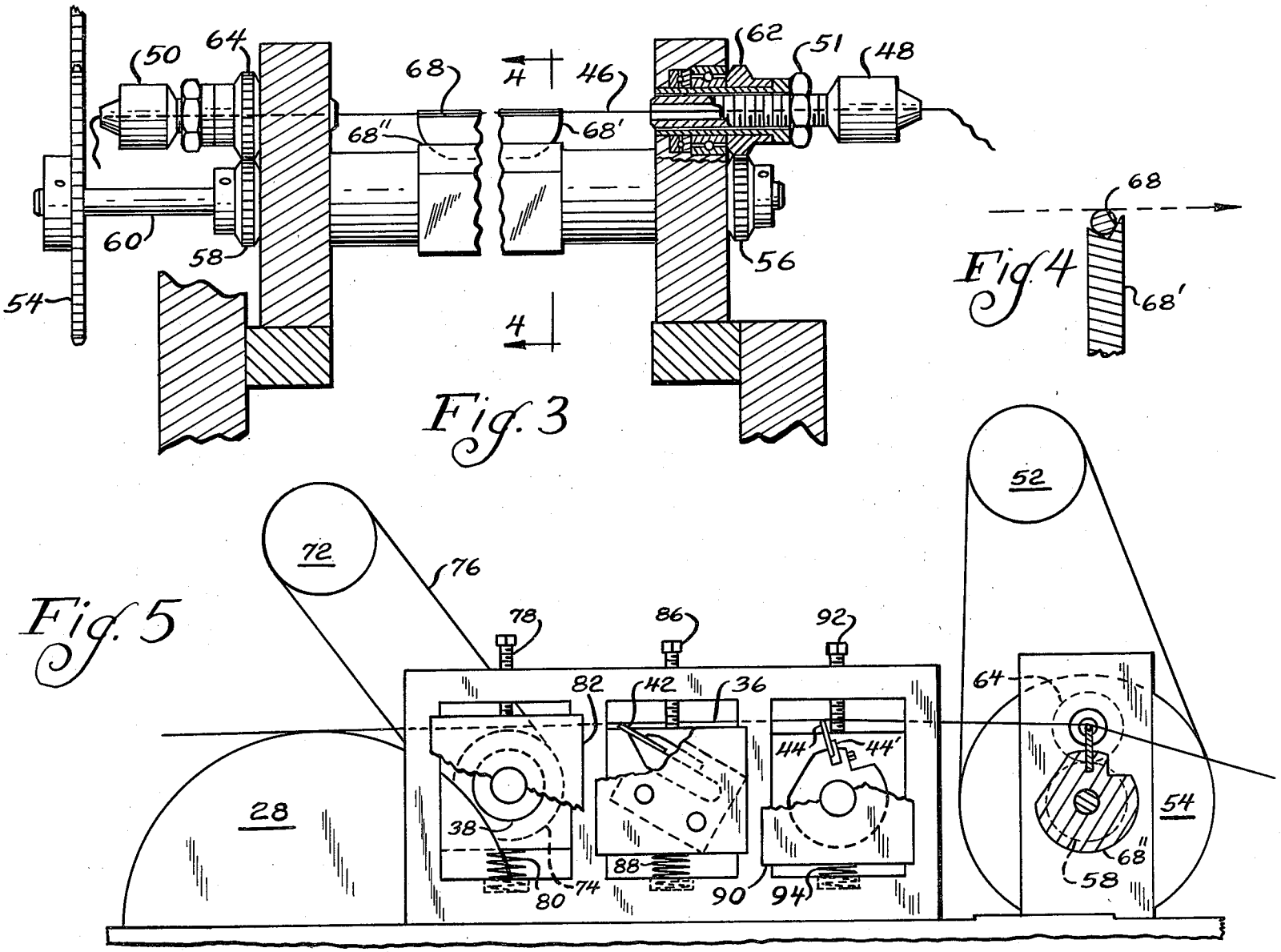
FIG. 3 is a partial sectional view taken on line 3—3 in FIG. 2.
FIG. 4 is an enlarged partial sectional view taken on line 4—4 of FIG. 3.
FIG. 5 is an enlarged, partially broken away, side elevational view of the inking section shown in FIG. 1.

Referring to FIG. 3, the wire 46 is mounted between a pair of chucks 48,50 which can be adjusted axially by nut 51 to provide tension in the rod 46. The rod 46 is rotated by motor 52 through drive sprocket 54. A pair of gears 56,58 fixed to shaft 60 are driven by sprocket 54, and in turn, drive gears 62,64 connected to chucks 48,50. A shallow v-trough 68 in support member 68′ mounted on holder 68″ provides a rigid support for rod 46. The trough 68 extends upwardly more at its downstream end than its upstream end as shown in FIG. 4 in order to resist the force of the paper and ink while at the same time facilitating the draining of the ink from the upstream end into the ink pan 32. Since the ink will build up a hydraulic pressure between the web 36 and rod 46, particles of ink will be forced upwardly through the pin holes which are usually present in carbonizing tissue. These particles are absorbed by blotter web 69 which continually unwinds from roll 70 to roll 71, and thus kept from settling on the uncoated side of web 36.

Figure 2:
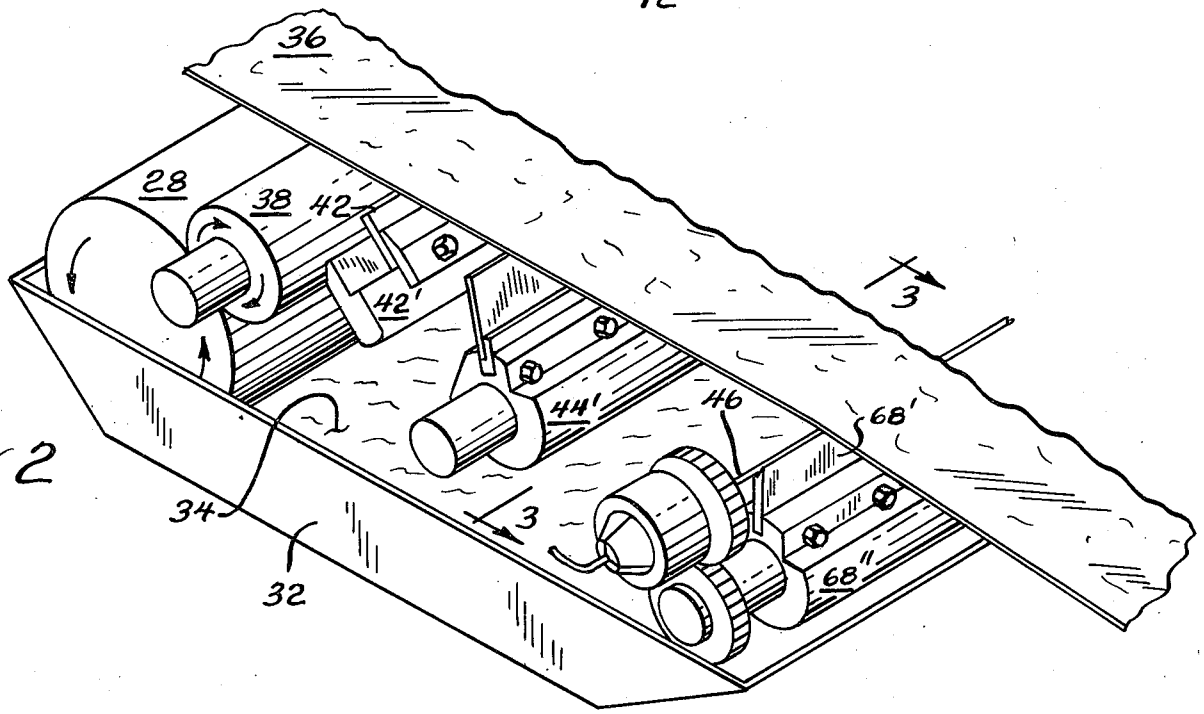
FIG. 2 is a fragmentary isometric view showing the relationship between a web being coated and my improved inking section.

Referring to FIG. 5, one can see that metering roll 38 is rotated by motor 72 by means of sprocket 74 and chain 76. The nip between dope roll 28 and metering roll 38 can be adjusted by means of adjustment screw 78 and spring 80 which move bearing support block 82 down and up relative to frame 12. In similar fashion, support block 84 is adjusted down and up by adjustment screw 86 and spring 88 to move the first doctor blade 42 down or up relative to web 36. The support block 90 for the second doctor blade 44 is moved down and up by adjustment screw 92 and spring 94. Since doctor blade 42 sees a great deal of excess ink, it is positioned at a 60° angle to the vertical to facilitate the runoff of the removed ink to the pan 34. The 10° angle of blade 44 also facilitates runoff and greatly reduces the size of the bead of ink which tends to form upstream of the blade when the blade is positioned vertically. Depending on the particular coating situation, the blades 42,44 can be adjusted to remove equal or unequal amounts of ink. The blades can also be replaced in their holders 42′,44′ as seen in FIG. 2. The final coating thickness is determined by equalizing rod 46 and will tend to decrease with decreases in the diameter of rod 46, increases in the paper tension, or decreases in paper feed speed. As can be seen in FIG. 5, the paper direction changes substantially as it passes over rod 46 on its way to chill roll 96 (FIG. 1). The direction change insures a firm scraping action.

As can be seen from the preceding description, the dope roll 28 applies an initial coating of ink at least about 0.010 inches to the web 36. The final product will usually have a coating weight of about 1 pound of ink per 4 pounds of paper but the final coating thickness is almost immeasurable since the ink is absorbed in the pores of the paper. Since the tremendous excess of ink which must be applied initially cannot be removed by the equalizer rod alone at high speed it will be readily appreciated that by multi-element inking system comprising a metering rod and two doctor blades upstream of a fine diameter equalizer rod provides quality coating at a production speed substantially greater than with any prior art system.

I claim as my invention:

1. In apparatus for coating tissue paper webs of the type including a coating roller for applying a hot liquid coating to the web and chilling rollers to solidify the coating, the improvement comprising: metering rod means for controlling the ink thickness on the coating roller, first doctor blade means positioned downstream of the coating roller and metering rod for lightly contacting the web for removing portions of the coating which exceed a predetermined thickness; second doctor blade means positioned downstream of said first doctor blade means for removing additional portions of said coating; an equalizer rod positioned for rotation about its axis downstream of the second doctor blade means, said equalizer rod having a diameter of less than 0.100 inches; and means for guiding the web to and from the equalizer rod so that the web changes its direction as it passes over the equalizer rod.

2. The coating apparatus of claim 1 wherein said metering rod means comprises a rotating metering roll member positioned closely adjacent to the coating roller.

3. The coating apparatus of claim 2 wherein said coating roller rotates in a direction opposite to the direction of feed of the paper web and the metering roll member rotates in the opposite direction, said metering roll member being positioned on the downstream side of the coating roller.

4. The coating apparatus of claim 3 wherein said metering roll member is spaced about 0.010–0.015 inches from said coating roller.

5. The coating apparatus of claim 1 wherein said equalizer rod has a diameter of less than about 0.078 inches.

6. The coating apparatus of claim 5 wherein said apparatus includes at least one thin metal strip overlying the coating roller for masking a portion of said web from contact with the liquid on said coating roller, said apparatus further including a web of absorbent material which is movable and positioned so that fresh portions thereof continually pass over the coated web in the region thereof immediately above said equalizer rod, said web of absorbent material serving to absorb particles of the liquid being coated which are forced upwardly through pinholes in the coated web as it contacts said equalizer rod.

7. The coating apparatus of claim 1 wherein said equalizer rod has a diameter of 0.046 inches or less.

8. The coating apparatus of claim 1 wherein said first doctor blade means is positioned at an angle to the vertical so as to be generally directed in the direction of the coating roller.

9. The coating apparatus of claim 8 wherein said first doctor blade means is positioned at an angle to the vertical of about 60°.

10. The coating apparatus of claim 8 wherein said second doctor blade means is also positioned at an angle to the vertical so as to be generally directed in the direction of the coating roller.

11. The coating apparatus of claim 10 wherein said first doctor blade means is positioned at about a 60° angle while said second doctor blade means is positioned at about a 10° angle.

12. The coating apparatus of claim 1 wherein at least one of said first and second doctor blade means is vertically adjustable for controlling the amount of coating removed thereby.

13. The coating apparatus of claim 12 wherein each of said first and second doctor blade means is vertically adjustable for controlling the amount of coating removed thereby.

* * * * *